US008529285B1

(12) United States Patent
Sievers

(10) Patent No.: US 8,529,285 B1
(45) Date of Patent: Sep. 10, 2013

(54) CABLE RETENTION CLIP FOR RUGGED APPLICATIONS

(75) Inventor: James P. Sievers, Cedar Rapids, IA (US)

(73) Assignee: Crystal Group, Inc., Hiawatha, IA (US)

( * ) Notice: Subject to any disclaimer, the term of this patent is extended or adjusted under 35 U.S.C. 154(b) by 0 days.

(21) Appl. No.: 13/309,118

(22) Filed: Dec. 1, 2011

Related U.S. Application Data

(60) Provisional application No. 61/419,127, filed on Dec. 2, 2010.

(51) Int. Cl.
*H01R 13/62* (2006.01)

(52) U.S. Cl.
USPC ..... 439/373

(58) Field of Classification Search
USPC ..... 439/371, 373, 369
See application file for complete search history.

(56) References Cited

U.S. PATENT DOCUMENTS 1,143,536 A * 6/1915 Goodridge ..... 439/361
2,266,560 A * 12/1941 Mansfield ..... 439/368
2,675,530 A * 4/1954 Sadasky ..... 439/365
2,721,313 A * 10/1955 English ..... 439/369
2,722,665 A * 11/1955 Sauder ..... 439/135
2,728,058 A * 12/1955 Phalen ..... 439/371
3,041,571 A * 6/1962 Friend et al. ..... 439/366
3,097,034 A * 7/1963 Jamrosy ..... 439/369
3,387,254 A * 6/1968 Wheeler ..... 439/470
3,475,716 A * 10/1969 Laig ..... 439/369
3,811,104 A * 5/1974 Caldwell ..... 439/135
3,871,731 A * 3/1975 LaCoursiere et al. ..... 439/369
4,204,738 A * 5/1980 Tillotson ..... 439/369
4,588,238 A * 5/1986 Mickelson et al. ..... 439/345
4,643,503 A * 2/1987 Johnson et al. ..... 439/227
4,702,709 A * 10/1987 Santilli ..... 439/144
5,044,976 A * 9/1991 Thompson ..... 439/368
5,174,781 A * 12/1992 Muzslay ..... 439/372
5,251,101 A * 10/1993 Liu ..... 361/717
5,323,845 A * 6/1994 Kin-shon ..... 165/80.3
5,328,384 A * 7/1994 Magnuson ..... 439/369
5,348,495 A * 9/1994 Kasden ..... 439/371
5,470,249 A * 11/1995 Manganello ..... 439/369
5,472,355 A * 12/1995 Wittmann ..... 439/373
5,507,664 A * 4/1996 Carmo ..... 439/372
5,593,313 A * 1/1997 Shibuya et al. ..... 439/373
5,782,648 A * 7/1998 Peterson ..... 439/369
5,860,827 A * 1/1999 Lee ..... 439/373
6,101,091 A * 8/2000 Baik ..... 361/704
6,176,728 B1 * 1/2001 Bonnet et al. ..... 439/362
6,246,589 B1 * 6/2001 August et al. ..... 361/801
6,276,952 B1 * 8/2001 Ferranti et al. ..... 439/345
6,327,159 B1 * 12/2001 Davies et al. ..... 361/788
6,491,539 B1 * 12/2002 Johnston ..... 439/373
6,739,896 B2 * 5/2004 Sivertsen ..... 439/371
6,767,237 B1 * 7/2004 Shih ..... 439/371

(Continued)

*Primary Examiner* — Ross Gushi
(74) *Attorney, Agent, or Firm* — Simmons Perrine Moyer Bergman PLC

(57) ABSTRACT

A system and method for retaining a commercial off the shelf connector and cable into a connector on a pc is shown and described as having a wire bail or retaining clip, which is either screwed to or forced into a friction fit behind a rear panel of the PC at the COTS connectors. The bail or retention clip extends beyond the end of the connector and cradles the cord, this helps to distribute the weight of the cord/cable. Also, the clip is sized and configured to make inadvertent disconnection of the connector less likely.

1 Claim, 3 Drawing Sheets

(56) References Cited

U.S. PATENT DOCUMENTS

| | | | | |
|---|---|---|---|---|
| 6,966,792 | B1 * | 11/2005 | Willers et al. | 439/373 |
| 7,118,414 | B2 * | 10/2006 | Spears et al. | 439/540.1 |
| 7,140,903 | B2 * | 11/2006 | Pulizzi et al. | 439/371 |
| 7,207,826 | B1 * | 4/2007 | Yang | 439/373 |
| 7,241,163 | B1 * | 7/2007 | Cox et al. | 439/445 |
| 7,303,432 | B1 * | 12/2007 | Chen et al. | 439/540.1 |
| 7,429,701 | B1 * | 9/2008 | Kushnir et al. | 174/53 |
| 7,513,791 | B1 * | 4/2009 | Gary | 439/373 |
| 7,695,305 | B1 * | 4/2010 | Ray et al. | 439/359 |
| 7,722,380 | B1 * | 5/2010 | West et al. | 439/373 |
| 7,850,478 | B2 * | 12/2010 | Lin et al. | 439/373 |
| 7,857,654 | B2 * | 12/2010 | West et al. | 439/373 |
| 7,938,671 | B2 * | 5/2011 | Hayden, Sr. | 439/371 |
| 8,029,308 | B2 * | 10/2011 | Saruwatari | 439/373 |
| 8,134,074 | B2 * | 3/2012 | Ong et al. | 174/135 |
| 8,197,279 | B1 * | 6/2012 | Yan et al. | 439/371 |
| 8,248,820 | B2 * | 8/2012 | Wu et al. | 361/807 |
| 8,287,298 | B2 * | 10/2012 | Hsu et al. | 439/352 |
| 8,337,236 | B2 * | 12/2012 | Shu | 439/369 |
| 2002/0068477 | A1 * | 6/2002 | Chen-Chiang et al. | 439/373 |
| 2003/0209361 | A1 * | 11/2003 | Sivertsen | 174/135 |
| 2004/0038581 | A1 * | 2/2004 | Brown | 439/373 |
| 2005/0164548 | A1 * | 7/2005 | Spears et al. | 439/540.1 |
| 2006/0264087 | A1 * | 11/2006 | Woellner et al. | 439/371 |
| 2008/0076291 | A1 * | 3/2008 | Ewing et al. | 439/373 |
| 2010/0248527 | A1 * | 9/2010 | West et al. | 439/371 |

* cited by examiner

CABLE RETENTION CLIP FOR RUGGED APPLICATIONS

FIELD OF THE INVENTION

The present invention generally relates to computers, and more particularly relates to personal computers, and even more particularly relates to commercial-off-the-shelf (COTS) rugged personal computers.

BACKGROUND OF THE INVENTION

In recent years, the use of COTS computer hardware has increased in military applications. COTS connectors, such as the PS/2 connector commonly used to connect keyboards and mice with their respective PCs, are liked because of their low cost and ease of insertion owing to their low insertion force design.

However, the downside to the low insertion force design is that unwanted disconnection can occur more frequently.

In the past, these unwanted disconnections have been addressed by adhesively bonding the PS/2 cable to the rear I/O panel of the computer or by including an add-on sheet metal bracket that to which PS/2 cables are lashed.

While these approaches have significant utility, there exists a need for low cost systems and methods which do not have some of the downfalls of the prior art methods.

For example, there is a need for a system and method which does not have the serviceability issues of increasing costs for maintenance because of increased time needed for repair, cleanup and removal operation, that is associated with the adhesive approach. Also, there is a need to avoid the intrusion in the cable routing space by the sheet metal bracket approach.

Consequently, there exists a need for improved methods and systems for securing COTS connectors in a military environment.

SUMMARY OF THE INVENTION

It is an object of the present invention to provide a system and method for retaining, in an efficient manner, the COTS connectors which exhibit unwanted disconnection from their respective personal computers.

It is a feature of the present invention to utilize a bail style retention clip which urges the COTS connector into its intended fully inserted position.

It is another feature of the present invention to include multiple points of connection between the retention clip and the connector and the retention clip and the computer.

It is an advantage of the present invention to provide low cost systems and methods for retaining COTS connectors.

The present invention is an apparatus and method for enhancing the proper retention of COTS connectors into military personal computers designed to satisfy the aforementioned needs, provide the previously stated objects, include the above-listed features, and achieve the already articulated advantages.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
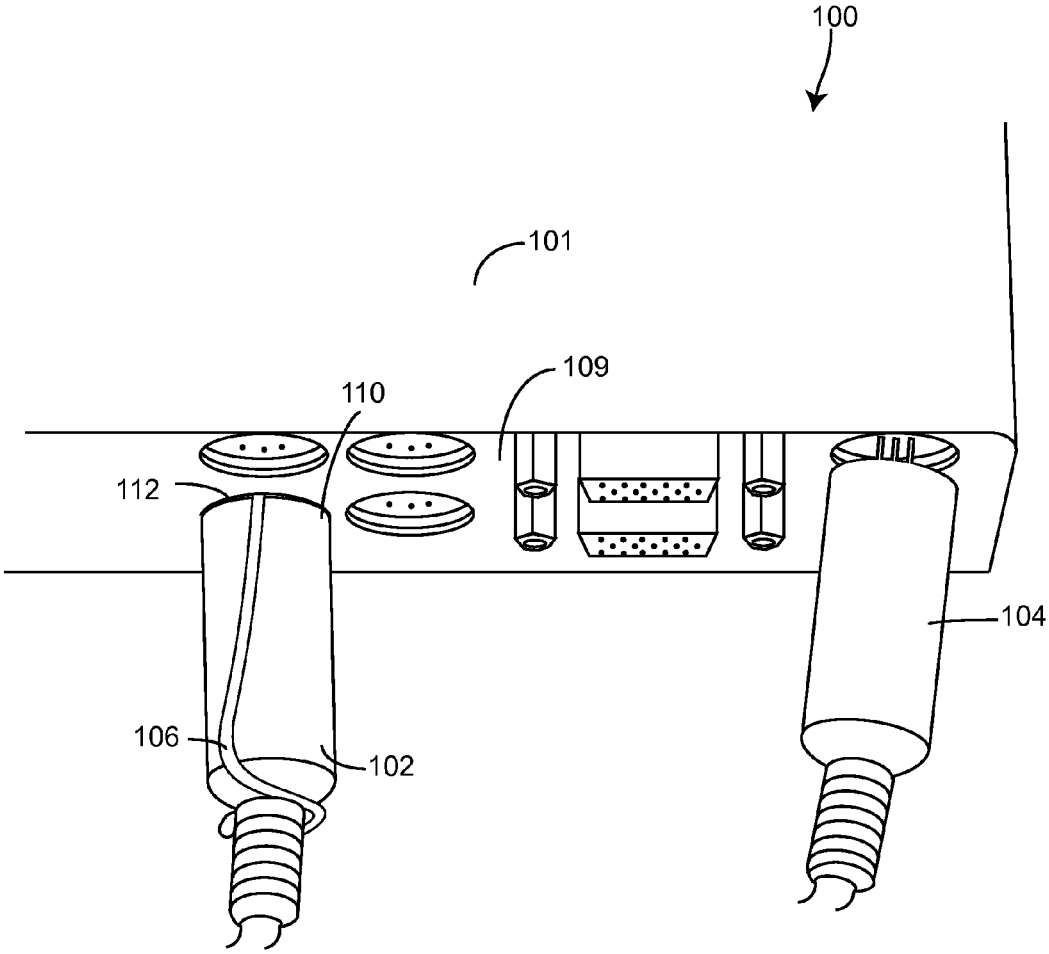
FIG. 1 is a simplified view of a system of COTS connector retention of the present invention disposed adjacent to a prior art connection without any connector retention structures.

Now referring to the drawings, wherein like numerals refer to like matter throughout, and more specifically referring to FIG. 1, there is shown a system of the present invention, generally designated 100, including a COTS military PC 101, or other device having COTS connectors, for receiving therein connections with COTS connectors, such as the PS/2; USB or other well known connectors.

A first COTS cable side connector 102 and a second COTS cable side connector 104 shown disposed in COTS chassis side connectors in the PC 101 or other device. COTS cable side connector 102 is shown with a bail retention clip 106 of FIG. 2. Also shown is an I/O plate cover 109 and an underlying computer chassis 110, which is shown by a component thereon being a connector 112.

Figure 2:
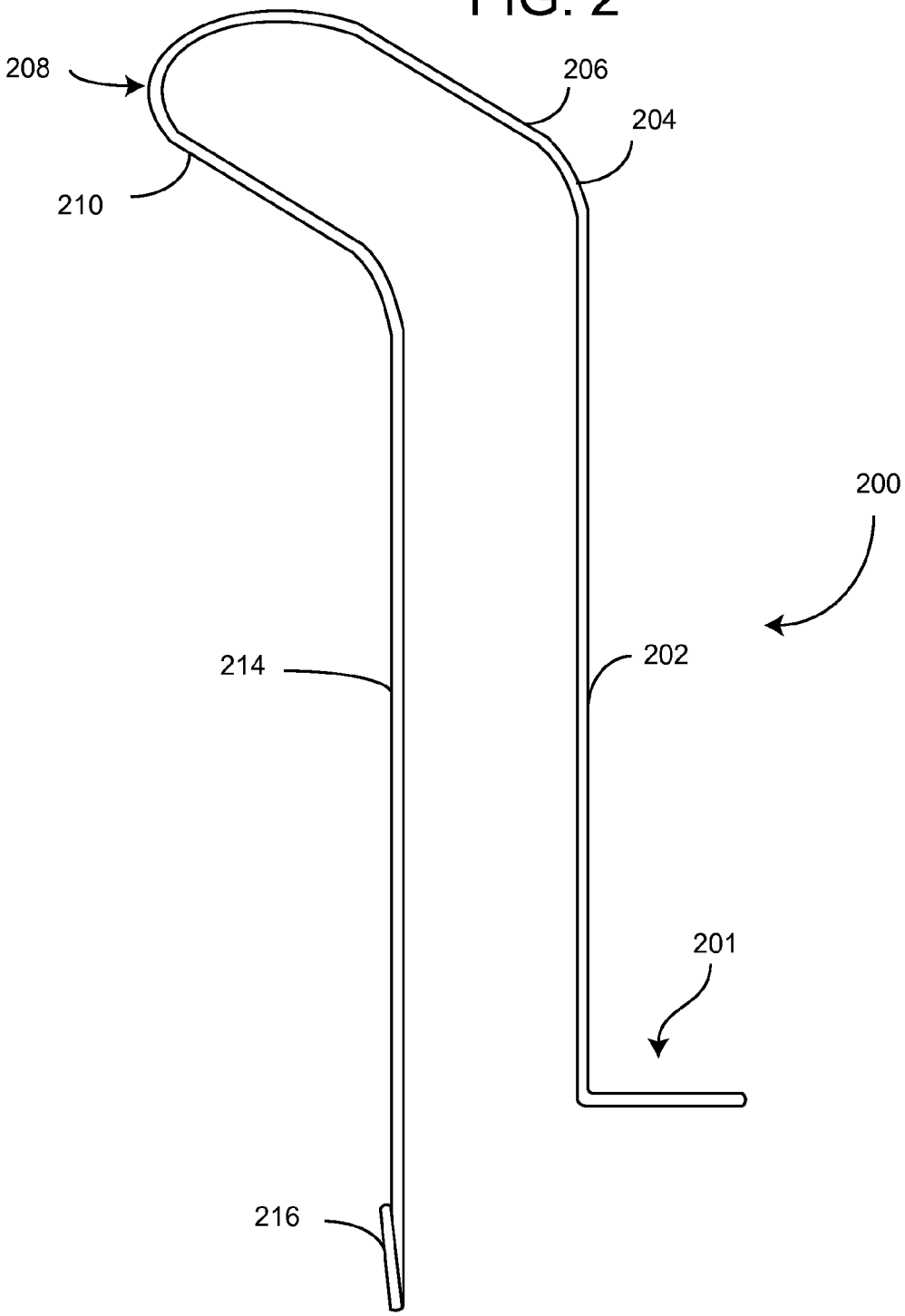
FIG. 2 is a simplified view of a full loop bail of the present invention with a quick friction fit connection for improved retention to the PC.

Now referring to FIG. 2, there is shown a full loop bail, generally designated 200, of the present invention, which includes a free end friction fit computer mating end 201 which is configured to be placed between an I/O plate cover 109 and an underlying computer chassis 110. There is shown orthogonal connector head extension segment 202 the length of which is dependent upon the connector head length for the particular cable connection being supported. Cable approaching bend 204 drops the bail so as to go beneath the cable extending out from the cable connection head. Cable traversing segment 206 may be straight or curved but it is at least partially dependent upon the thickness of the connector head and the cable. Cable cradling segment 208 is formed to support the cable from beneath and to stop the connector from being move directly out of the connector receiver on the PC101. Second cable traversing segment 210 is analogous to cable traversing segment 206 and leads to second orthogonal connector head extension segment 214, which leads to elongated end 216. Note, the present invention can utilize a retention clip that has one or more connections or contact points with the PC101 so as to better limit unintended disconnection of connectors. Elongated end 216 could be inserted into a air vent hole, pressed into a friction fit either inside, outside or partially inside the PC 101. Note a special mating hole could be made in the I/O cover plate to receive the elongated end 216. In some embodiments the free end friction fit computer mating end 201 could also engage some structure on the exterior of the PC 101.

Figure 3:
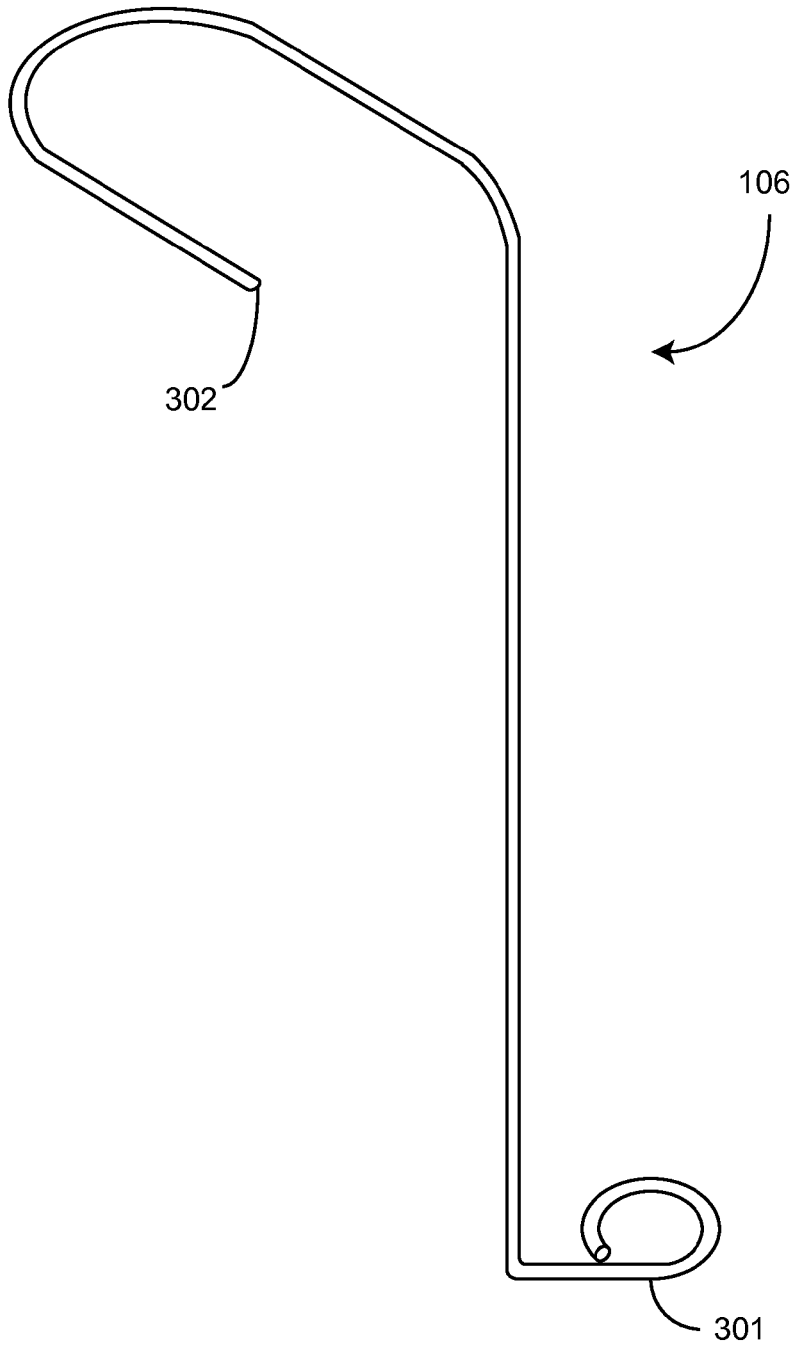
FIG. 3 is a simplified view of a full loop bail with a hardware retention loop of the present invention.

Now referring to FIG. 3, there is shown a bail clip 106 of FIG. 1 comprising a free end loop 301 and a truncated end 302 instead of a second cable approaching bend 212, second orthogonal connector head extension segment 214, and elongated end 216.

In operation, the apparatus and method of the present invention could function as follows: The bail clip 106 is either attached to the chassis 110 via a screw, pin, etc., and free end loop 301 or it is wedged into a gap between the I/O plate cover 109 and the computer chassis 110, much like section 201 of FIG. 2, or it engages with some external structure on the PC 101.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

I claim:

1. A method of reducing unwanted disconnections of COTS cables from personal computer comprising the steps of:

inserting a COTS cable connector into a device connector on a personal computer; and securing said COTS cable connector to said device connector by engaging a single piece of wire which extends from a around a cable coupled to said COTS cable connector to said personal computer;

wherein said step of securing comprises: screwing a screw disposed in a loop in said single piece of wire, into a void in a back side of said personal computer.

* * * * *